United States Patent [19]

Eckerle

[11] 4,132,514

[45] Jan. 2, 1979

[54] HIGH PRESSURE HYDRAULIC GEAR PUMP OR MOTOR

[76] Inventor: Otto Eckerle, Am Bergwald 6, 7502 Malsch, Fed. Rep. of Germany

[21] Appl. No.: 767,318

[22] Filed: Feb. 10, 1977

[30] Foreign Application Priority Data

Feb. 16, 1976 [DE] Fed. Rep. of Germany ..... 2606082

[51] Int. Cl.[2] ..... F04C 15/00; F04C 1/06

[52] U.S. Cl. ..... 418/71; 418/126; 418/131; 418/170

[58] Field of Search ..... 418/71, 126, 129, 131, 418/132, 133, 72, 73, 169, 170

[56] References Cited

U.S. PATENT DOCUMENTS

| | | | |
|---|---|---|---|
| 260,678 | 7/1882 | Hardy | 418/170 X |
| 2,482,713 | 9/1949 | Jones | 418/170 X |
| 3,486,459 | 12/1969 | Eltze | 418/126 |
| 3,779,674 | 12/1973 | Eckerle et al. | 418/71 |

FOREIGN PATENT DOCUMENTS

| | | | |
|---|---|---|---|
| 1653837 | 3/1975 | Fed. Rep. of Germany | 418/131 |

*Primary Examiner*—Carlton R. Croyle
*Assistant Examiner*—Leonard E. Smith
*Attorney, Agent, or Firm*—Joseph A. Geiger

[57] ABSTRACT

A high pressure hydraulic gear pump or motor of the internally geared type with a radially movable sealing plate arranged on one side of the filler member so as to form a seal against one gear, while the filler member forms a seal against the other gear, the sealing plate being arranged in a floating mode, with a sealing batten underneath it and springs biasing the plate and the batten radially outwardly. Pressure space delimiting control edges and tooth prefill passages are arranged on the sealing plate and on the filler member.

22 Claims, 19 Drawing Figures

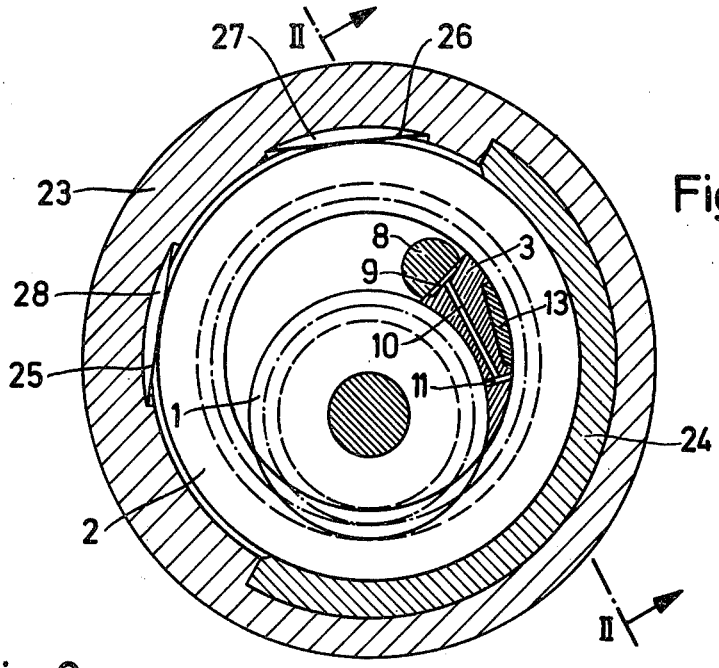
Fig.1
Fig. 2
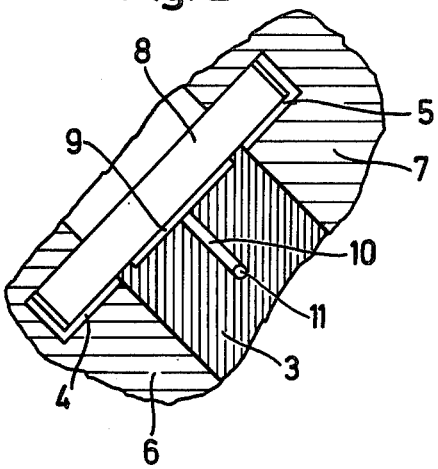
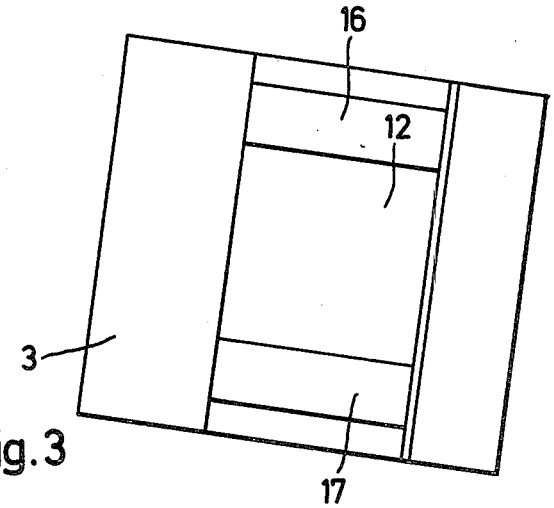
Fig.3
Fig. 4
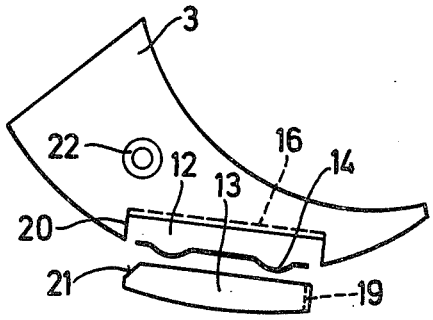

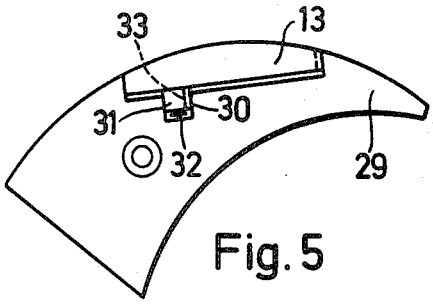
Fig. 5
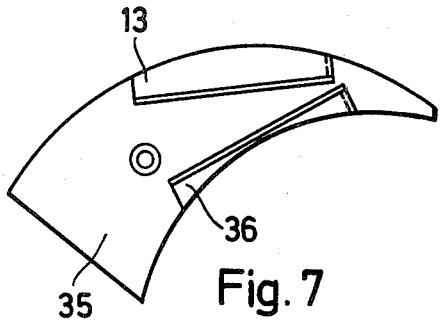
Fig. 7
Fig. 6
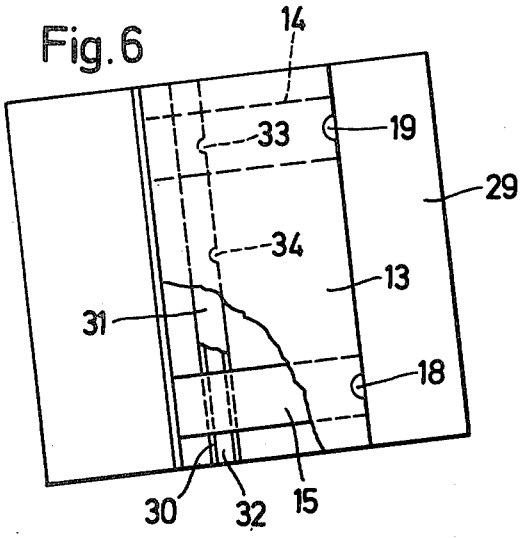
Fig. 10
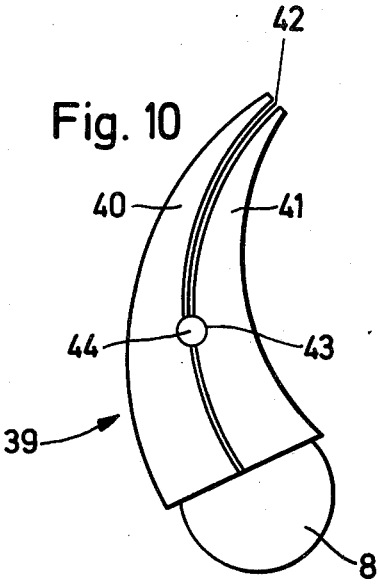
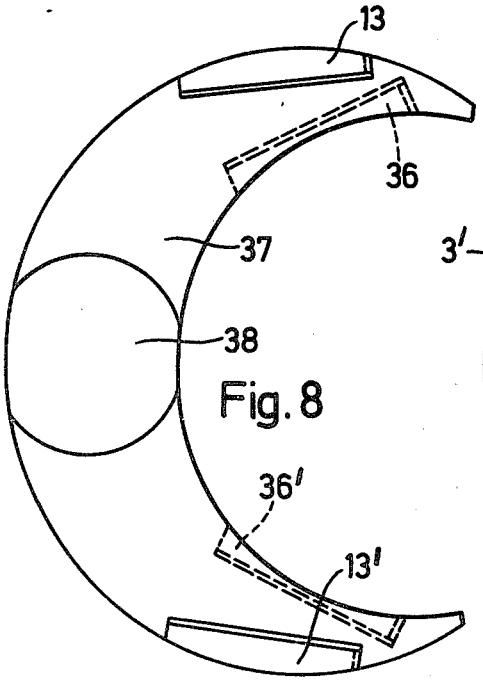
Fig. 8
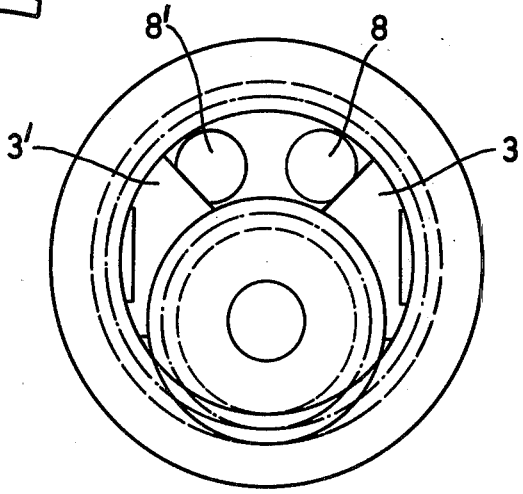
Fig. 9

Fig. 11
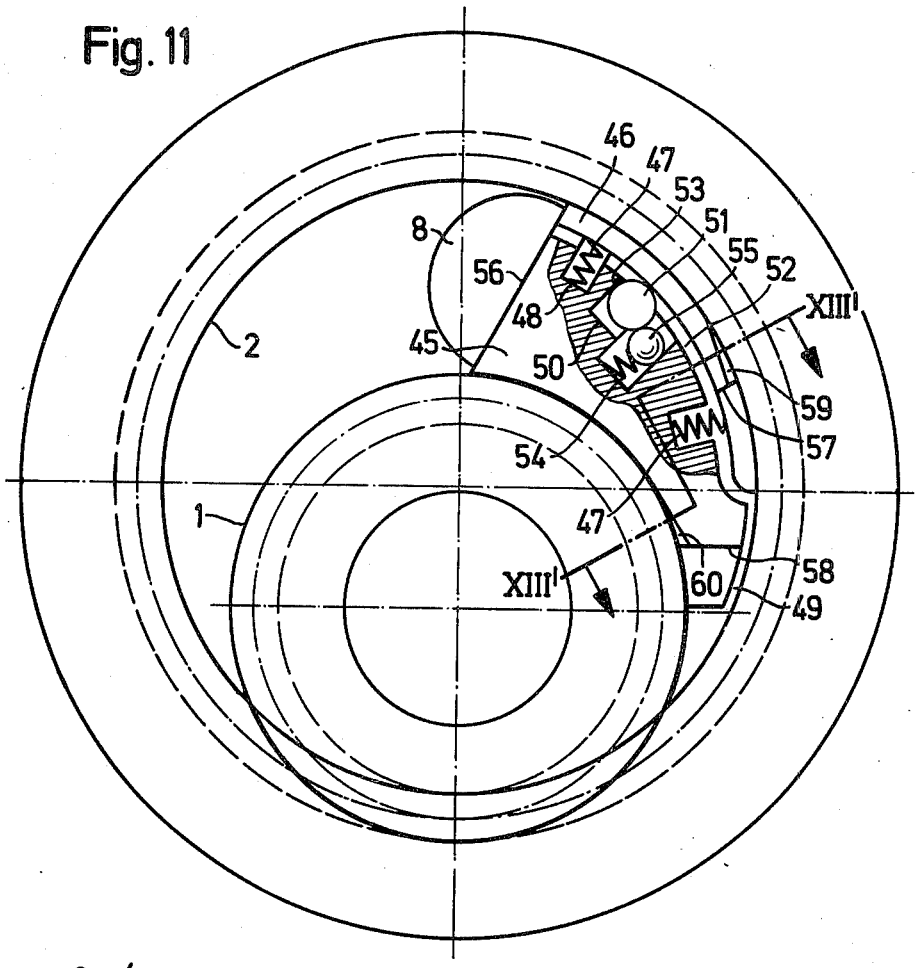
Fig. 12
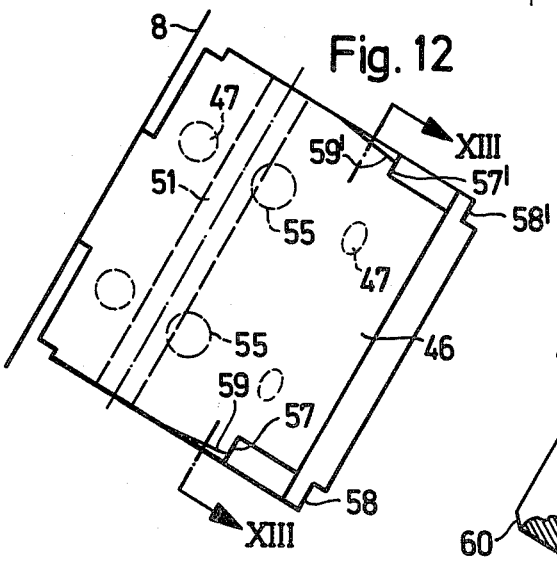
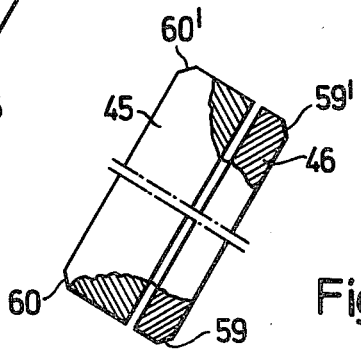
Fig. 13

Fig. 18
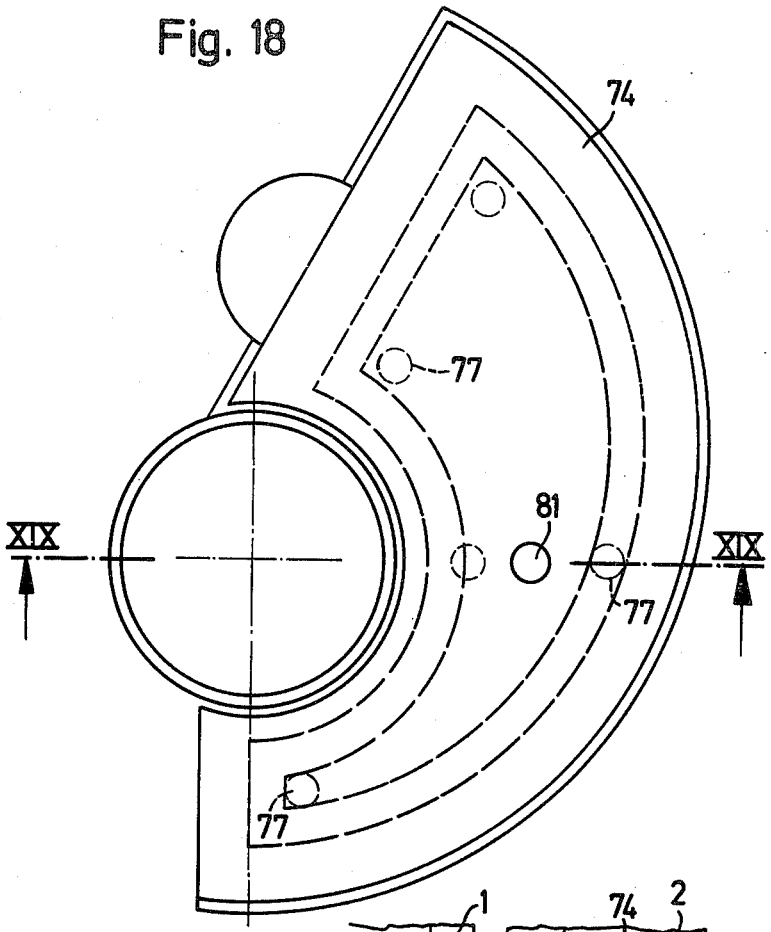
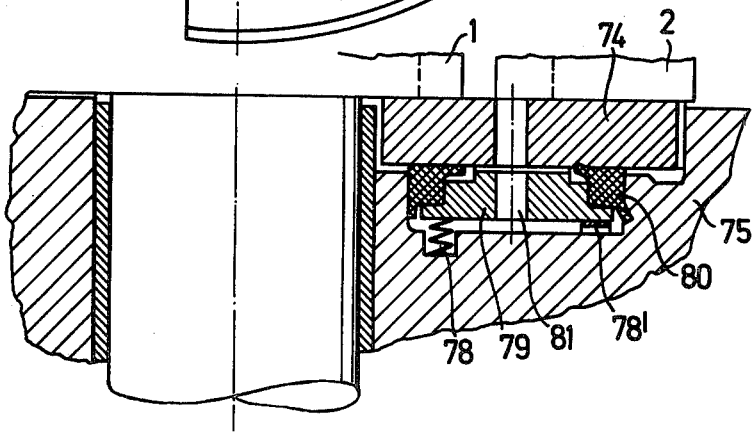
Fig. 19

HIGH PRESSURE HYDRAULIC GEAR PUMP OR MOTOR

BACKGROUND OF THE INVENTION

1. Field of the Invention

The present invention relates to hydraulic gear pumps and motors, and, more particularly, to high pressure gear pumps of the type having a drive pinion cooperating with a surrounding internal gear ring and an intermediate filler member.

2. Description of the Prior Art

High pressure hydraulic gear pumps of the internally geared type have been known for some time. Such a gear pump may have a filler member of sickle-shaped outline, or one or two semi-sickle-shaped or curved-wedge-shaped members.

In operation, the three basic constituent members of the gear pump, pinion, internal gear ring, and filler member, are subjected to friction under pressure and consequently undergo uneven operating wear. This uneven wear results from the directional nature of the hydraulic pressures which are generated inside the hydraulic pump or motor in the axial as well as radial sense.

The prior art in this field already contains various suggestions aimed at reducing the operating wear by arranging compensating pressure fields inside the gear pump through which the directional pressures are fully neutralized or almost fully neutralized. It is known, for example, that the axial pressures can be compensated for by arranging on both sides of the gears axially movable pressure plates which have arranged on their outer sides suitable compensation pressure fields of predetermined shape which are subjected to the operating pressure of the hydraulic pump or motor.

Several other prior art suggestions concern themselves with the compensation of the radial pressures, especially the pressure to which the rotating internal gear ring is subjected. These solutions include three basic approaches:

(a) The internal gear ring is radially displaceable and its displacement is controlled by a control piston, or by one or more pressure compensation fields on the outer periphery of the internal gear ring, whereby the latter is pushed radially inwardly against the filler member and the pinion;

(b) The filler member is a curved wedge and its supporting pin is displaceable in the circumferential sense, the displacement of the pin being controlled by means of a compensation piston, so that the filler wedge is advanced into sealing contact with the converging teeth of the pinion and internal gear ring;

(c) The drive pinion is displaceable in a radial direction, the displacement of the pinion being controlled by hydraulic compensation pistons which engage the shaft extensions of the pinion, thereby pushing the pinion radially against the filler member.

A common shortcoming of these pressure compensation approaches is their design complexity, which reflects itself in a need for very close production tolerances, with attendant assembly problems and consequent high production costs. A further common disadvantage of these prior art hydraulic pumps and motors is that their design complexity reflects itself in greater overall space requirements.

SUMMARY OF THE INVENTION

Underlying the present invention is the primary objective of providing an improvement over the known prior art solutions in terms of obtaining an effective radial pressure compensation with simpler means which, while lowering manufacturing costs, also reduce the space requirements of the hydraulic pump or motor.

The present invention proposes to attain these objectives by suggesting an improved high pressure hydraulic gear pump or motor of the earlier-mentioned internally geared type which features a filler member carrying one or more radially displaceable sealing elements which cooperate with the pinion and/or the internal gear ring to provide a sealing contact. These sealing elements may be in the form of curved plates or disc-type pistons, or the filler member itself may consist of two sections or halves of which one is displaceable relative to the other and capable of serving as the radially displaceable sealing element. The sealing elements are pressure compensated, the rear side of each sealing element being connected to the pressure side of the pump by means of suitable slots, channels, or bores.

The arrangement of a displaceable sealing element on the filler member itself makes it possible to dispense with the previously required control pistons, compensation pistons, or other compensation elements, thereby greatly simplifying the overall design of the hydraulic pump or motor. The latter can therefore have smaller overall dimensions, and it no longer necessitates special sealing gaskets. These simplifications notwithstanding, the suggested improved hydraulic gear pump or motor is capable of maintaining effective operating contact between the three basic operating components, under relative radial displacements of these compenents inside the pump or motor, displacements which may be due to operational wear, heat expansion, and/or the effects of the viscosity of the hydraulic pressure medium.

The present invention further suggests that the sealing element, or elements, which are carried by the filler member, be so arranged that the hydraulic forces on its radially inner and outer sides compensate each other, i.e. they are equal or almost equal in size and opposite in direction, so as to "float" the sealing member, while a certain contact pressure, derived either from a spring or from the hydraulic operating pressure, establishes sealing contact with the two gears. While a certain contact pressure between the sealing element and the cooperating gears is necessary to assure an efficient pumping action, an over-compensation of the operating pressure on the sealing element may lead to rapid wear of the latter. This is the case, for example, when the outwardly acting pressure underneath the sealing element is substantially greater than the inwardly directed pressure on the outer side of the sealing element.

Pressure equalization can be achieved conveniently by arranging slots or grooves in the filler member or in the sealing element itself. The floating arrangement of the sealing element has the additional advantage of making it unnecessary for the sealing element to be precisely fitted into the filler member, thus eliminating the need for imposing close manufacturing tolerances. The absense of a close fit between the sealing element and the surrounding wall of the filler member has the further advantage of allowing for heat expansion of the sealing element during operation.

By way of a further improvement of the novel high pressure hydraulic pump or motor, the present invention also suggests an improved rotary support for the internal gear ring. It is a known phenomenon that the internal gear ring undergoes an increase in diameter shortly after startup of the pump or motor, regardless of whether its support is of the hydrostatic or hydrodynamic type. This increase in size of the internal gear ring could lead to a seizure condition between the ring and its surrounding bore, if one were to attempt to rigidly position the internal gear ring, using the housing bore as a bearing surface.

It is therefore common practice to support the internal gear ring in a floating manner. Such a floatingly supported gear ring, however, has the undesirable tendency, during startup, of being pulled against the pinion, thereby creating elevated tooth engagement pressures and tooth wear.

In order to prevent this condition from occurring, the invention therefore suggests that the internal gear ring be supported in a preloaded, partially yielding manner, an open bearing shell which is fixedly arranged in the pump housing supporting the internal gear ring against the operating load, while one or several spring members or similar elastically yielding bearing members preload the internal gear ring into the bearing shell. This arrangement makes it possible to provide a certain flank clearance between the gear teeth which, in turn, means that the gears need not be manufactured with the very close tolerances that are otherwise necessary.

As a result of extensive testing, it has further been found that, under certain circumstances, it is possible for the sealing plate of the invention to assume a position in which it no longer contacts the cooperating internal gear ring with its full outer surface. Such a situation may result from the combined effects of wear and manufacturing tolerances of the gear ring support, of the gears, and of the filler member. The resultant canting tendency of the sealing plate creates elevated contact pressures and increased wear on the edge portions of the sealing plate. Lastly, the change in contact surface also creates a problem with regard to pressure compensation on the sealing plate.

These problems can be eliminated, if, in accordance with a further suggestion of the present invention, the transverse sealing batten of rectangular cross section is replaced with a sealing batten in the form of a roller or cylinder which, by engaging a flank of the filler member, is capable of undergoing a rolling displacement, so as to adapt its position at all times to the position of the sealing plate.

For proper operation of the pump or motor in the pressureless condition, it is necessary for the roller-type sealing batten to contact at all times a positioning flank of the receiving groove inside the filler member, as well as the sealing plate itself. In order to accomplish this, the present invention suggests that spring elements be arranged to exert a preload on the sealing batten, but, preferably, with pressure balls arranged between the roller-type sealing batten and the spring elements, whereby the pressure balls engage the sealing batten at an angle, under which the sealing batten is biased against the positioning flank of the receiving groove as well as outwardly, against the sealing plate. The spring elements arranged underneath the pressure balls may be helical compression springs or leaf springs, for example.

Another important prerequisite of proper operation of the suggested high pressure pump or motor is that the rear abutment face of the sealing plate be aligned accurately at right angles to the axial side faces. A similar requirement exists with respect to the filler member itself. If the alignment of the sealing plate is obtained by means of a transverse flank of the filler member, the latter must be machined very precisely. By way of a further improvement, the present invention suggests an alternate possibility, according to which the sealing plate is extended rearwardly towards the supporting pin which positions the filler member, engaging with the filler member a common abutment face of the supporting pin. Any tendency of the gears, during startup of the pump, to shift the filler member in the direction of the converging teeth is suppressed, as a result of the friction forces which are created by the spring-biased sealing plate which, due to the wedge shape of the assembly, creates a force component in the direction towards the supporting pin.

By way of further refinements of the suggested novel pump, the preferred embodiment thereof also suggests that the so-called "prefill passages", which delimit the suction and pressure spaces and which have previously been provided in the form of grooves or chamfers in the axial side plates, are now advantageously arranged on the sealing plate and/or on the filler member, respectively. This approach has the advantage that it makes it possible for the axial side plates to be produced as simple die cut plates; the filler member itself is always a machined part.

The use of axial side plates in connection with known high pressure gear pumps or gear motors can create a certain problem, in that the side plates increase the axial distance between the support points of the pinion shaft in its bearings, thereby increasing the tendency of the shaft to deflect under high pressures. This disadvantage can be overcome, if, as further suggested by the present invention, the side plates are axially recessed into the sides of the pump housing.

A still further suggestion relates to the axial pressure compensation means provided in connection with high pressure gear pumps and motors. For operation in a pressureless state, it is necessary that the axial side plates be preloaded against the gears by means of compressible elements. In known gear pumps the preload is obtained with the aid of the gasket itself. This approach, however, has the disadvantage that the material of the gasket has a tendency to deform or creep. The present invention avoids this condition by suggesting that the necessary spring pressure on the side plates be provided by means of helical compression springs or undulated leaf springs, the spring pressure being preferably not applied directly to the gasket, but to a pressure member which assures an even pressure distribution on the gasket. The supporting member also serves the purpose of pressing the gasket against the outer wall of the pressure field recess.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows:

FIG. 1 is a cross section of an internally geared high pressure hydraulic gear pump or gear motor embodying the present invention;

FIG. 2 is a partial cross section through the pump of FIG. 1, taken along line II—II thereof;

FIG. 3 is an enlarged representation of the filler member of the pump of FIG. 1, as seen from above;

FIG. 4 shows the filler member of FIG. 3 in a side view;

FIG. 5 is a side view of a modified filler member, adapted for a different embodiment of the invention;

FIG. 6 is a plan view of the filler member of FIG. 5;

FIG. 7 is a side view of still another filler member, adapted for a third embodiment of the invention;

FIG. 8 is a side view of a filler member of the sickle-shaped type;

FIG. 9 shows a reversible gear pump equipped with two filler members, as part of still another embodiment of the invention;

FIG. 10 is a side view of still another filler member design, featuring a two-piece structure;

FIG. 11 is a cross section of another internally geared hydraulic gear pump or gear motor, likewise embodying the invention;

FIG. 12 is a plan view of the filler member of the embodiment of FIG. 11;

FIG. 13 is a cross section through the filler member of FIGS. 11 and 12, taken along line XIII—XIII thereof;

FIG. 18 is a partial axial side view of a pump of the invention, showing the support of the pinion shaft and the filler member support pin; and FIG. 19 is a transverse cross section through the assembly of FIG. 18, taken along line XIX—XIX thereof.

DESCRIPTION OF THE PREFERRED EMBODIMENTS

Figure 14:
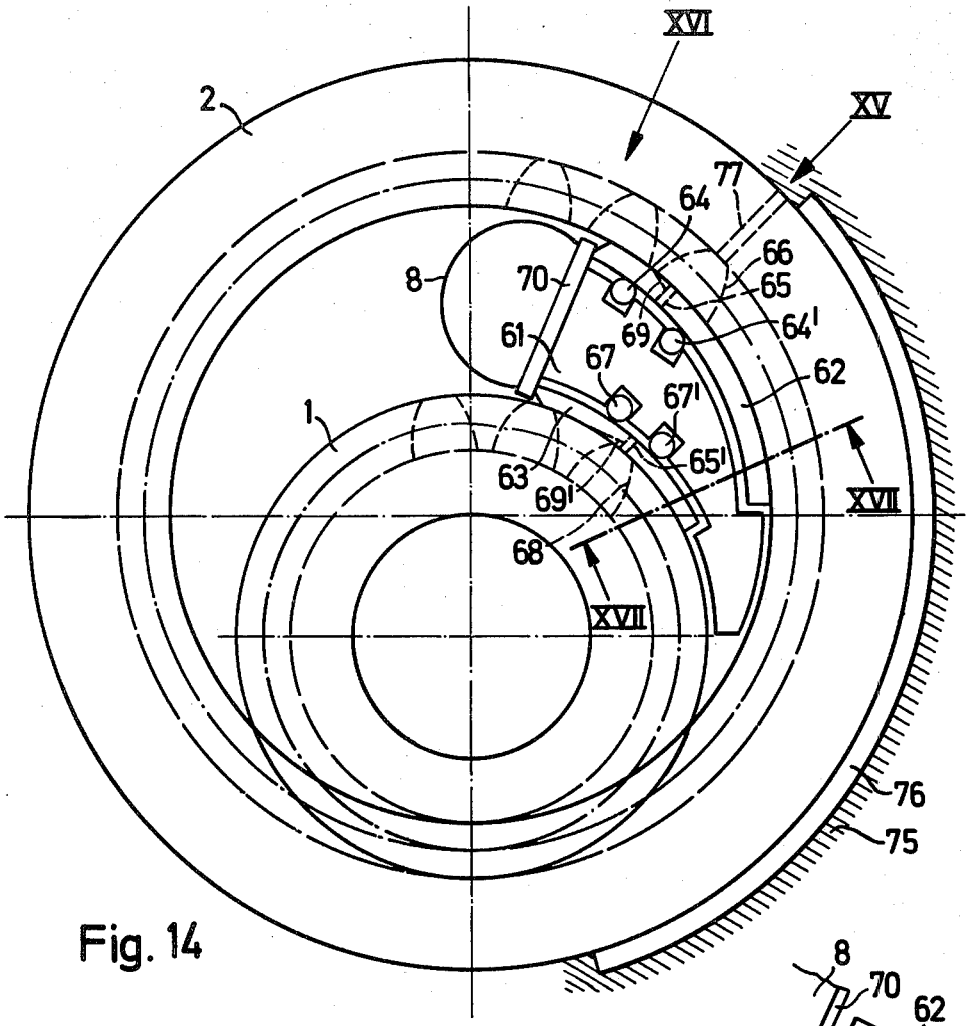
FIG. 14 shows still another internally geared hydraulic pump embodying the present invention.

Referring to FIGS. 1 through 4 of the drawing, there is shown a hydraulic pump consisting of a drive pinion 1, a cooperating internal gear ring 2, and a semi-sickle-shaped, or curved-wedge-shaped filler member 3. The filler member 3 is supported in the circumferential sense against a supporting pin 8 which engages positioning bores 4 and 5 in the housing parts 6 and 7 (FIG. 2). In order to compensate for the effect of the operating pressure on the filler member 3, which is being pushed rearwardly against the supporting pin 8, the latter engages the back side of the filler member with an abutment face which covers a pressure field 9 defined by a shallow recess in the rear face of the filler member 3. The pressure field 9 is linked to the pressure zone between the converging gear teeth via a longitudinal connecting channel 10 and a cross channel 11. The cross channel 11 also serves as a relief channel or as a prefill channel for the tooth chambers of the gear ring 2 and pinion 1.

On the outer side of the filler member 3 is arranged a transversely extending shallow recess 12 inside which is received a sealing element in the form of a plate 13. The sealing plate 13 has a certain clearance against the flanks of the recess 12, so as to allow for longitudinal expansion of the plate 13, under the influence of operational heat buildup. Underneath the sealing plate 13 are arranged two leaf springs 14 and 15 (FIG. 4 or FIG. 6), the leaf springs being received inside positioning recesses 16 and 17 which are located on opposite axial sides of the transverse recess 12.

In order to assure that pressurized fluid reaches the underside of the sealing plate 13, the forward edge of the plate 13, or the associated flank of the recess 12, has arranged therein two pressure channels 18 and 19 which are visible in FIG. 6.

In operation, the sealing plate 13 is pushed rearwardly in the circumferential direction, against the flank 20 of the transverse recess 12 of the filler member 3. In order to at least partially compensate for this pressure, it is advisable to provide a chamfer 21 on the rear face of the sealing plate 13, as shown in FIG. 4, so that a transverse channel is formed between the plate 13 and the recess flank 20, for the creation therein of a compensating pressure. FIG. 4 further shows a transverse bore 22 in the filler member 3, for the accommodation of an elastic pin by means of which the filler member 3 is preloaded circumferentially against the supporting pin 8. (For further details on such an arrangement, see U.S. Pat. No. 3,890,066.)

FIG. 1 also shows a novel rotary support for the internal gear ring 2, using an open, approximately semi-cylindrical bearing shell 24 which is supported inside a housing ring 23, so as to support the gear ring 2 in opposition to the radial hydraulic thrust resulting from the pump operation. Two elastic elements, in the form of leaf springs 25 and 26, for example, bear against the outer circumference of the internal gear ring 2, thereby pushing the latter into the bearing shell 24. The elastic elements 25 and 26 are received inside suitable peripheral recesses 27 and 28, respectively, of the housing ring 23.

The action of the elastic elements 25 and 26 is particularly important during startup of the pump, when the latter has a tendency to pull the gear ring 2 closer against the pinion 1. On the other hand, it should be understood that the various elastic elements or leaf springs 14, 15, 25, and 26 may be replaced by suitable piston assemblies, or the like, which are subjected to the operating pressure of the pump, thereby producing a comparable preloading action.

In FIGS. 5 and 6 is shown a modified filler member 29 which differs from the previously described filler member 3 in that a sealing batten 31 is arranged on the underside of the sealing plate 13, inside a transverse groove 30. A narrow leaf spring 32, arranged underneath the sealing batten 31, preloads the latter radially outwardly against the filler member 29, especially during startup of the pump. While the pump is in operation, the pressure of the leaf spring 32 is augmented by the action of pressurized fluid which flows underneath the sealing batten 31, via the pressure channels 33 and 34. The purpose of the sealing batten 31 is to provide a metallic seal between the sealing plate 13 and the filler member 29, thereby eliminating the necessity of having to provide a sealing fit between the plate 13 and the rear flank of the transverse recess of the filler member 29.

In FIG. 7 is shown still another modification of the filler member of the invention, the filler member 35 carrying not only the previously described sealing plate 13 on its outer or upper side, but also a second sealing plate 36 on its inner side. The latter, much like the previously described outer sealing plate 13, sits on a preloading spring (not shown) which pushes the sealing plate 36 against the pinion 1 and which is hydraulically floating in relation to the filler member 35.

In FIG. 8 is shown a sickle-shaped filler member 37, as part of a reversible gear pump or gear motor. Trunnions 38 on opposite axial sides of the filler member 37 position the filler member 37 in the pump housing, either pivotably or rigidly. Two sealing plates 13 and 13' are arranged on the outer periphery of the sickle-shaped filler member 37, in the area of tooth convergence. Alternatively, appropriate sealing plates 36 and 36' may be arranged on the inner periphery of the filler member 37 (as shown in dotted lines).

Another reversible pump configuration is shown in FIG. 9, where the sickle-shaped filler member has been replaced with two filler wedges 3 and 3' which are supported in the circumferential sense by two supporting pins 8 and 8', respectively. The filler members or curved wedges 3 and 3' are otherwise similar to those which have been described further above with reference to FIGS. 1 through 7.

Still another form of a filler member for a pump as suggested by the present invention is shown in FIG. 10, where the filler member 39 consists of two filler members sections 40 and 41 which are both supported in the circumferential sense against a supporting pin 8. A leaf spring 42, arranged radially between the two filler member sections 40 and 41, pushes them apart in the radial sense. In order to delimit the hydraulic pressure field between the two filler member sections in terms of its circumferential length, so as not to reach as far as the supporting pin 8, there is provided, in the interface between the two sections 40 and 41, a transverse bore 43, and inside the latter is seated a round sealing strip 44 or rubber or plastic material.

FIGS. 11 through 13 show a substantially different embodiment of the invention with a filler member 45 and a sealing plate 46 which is being biased radially outwardly by means of four compression springs 47, seated inside bores 48 of the filler member 45. In order to assure the flow of pressure fluid to the underside of the sealing plate 46, the filler member 45 has its tip portion recessed in the radial sense, so as to leave a fluid passage 49 between the tip portion and the internal gear ring 2.

Inside a transverse groove 50 of the filler member 45 is arranged a sealing batten 51, the latter having the form of a roller or cylinder. Compression springs 54, seated inside bores, engage the sealing batten 51 either directly or indirectly, preloading it radially outwardly against the sealing plate 46. This preload assures sealing contact during startup of the pump. During regular operation, the contact pressure between the sealing plate 46 and the teeth of the internal gear ring 2 is provided primarily by the pressure fluid which moves through the fluid passage 49, into the peripheral gap 52 between the filler member 45 and the sealing plate 46, and from there under the sealing batten 51. The purpose of this sealing batten is to provide a metallic seal on the underside of the sealing plate 46. Thanks to the roller-shape of the sealing batten 51, no special precision fit is necessary between the batten and its receiving groove 50.

In the preferred embodiment shown in FIG. 11, the compression springs 54 do not bear directly against the sealing batten 51, but have pressure balls 55 interposed between them and the sealing batten 51 which, due to their offset position in relation to the batten 51, cause the latter to be also biased against the rear flank 53 of the transverse groove 50. This offset is preferably such that the pressure axis between the pressure balls 55 and the sealing batten 51 is inclined approximately 45 degrees from the radial direction.

Unlike in the previously described embodiments of the filler member and sealing plate, where the latter is received in a recess of the former, the sealing plate 46 of the embodiment of FIGS. 11–13 is extended rearwardly over the full length of the filler member 45, so as to be flush with its rearward abutment face 56 and to be positioned directly by the supporting pin 8.

Lastly, the embodiment of FIGS. 11–13 further suggests that the control edges which separate the pressure space from the suction space be conveniently arranged on the sealing plate 46, in the form of control edges 57 and 57', and on the filler member 45, in the form of control edges 58 and 58'. So-called "prefill passages" are arranged on the pressure plate 46, in the form of chamfers 59 and 59', and on the filler member 45, in the form of chamfers 60 and 60'.

Figure 15:
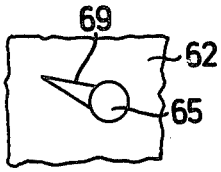
FIG. 15 shows a portion of the sealing segment of FIG. 14, as seen along arrow XV.
Figure 16:
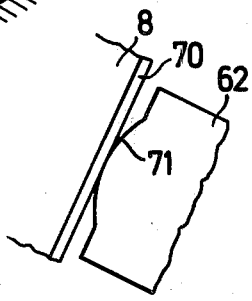
FIG. 16 shows a portion of the sealing segment of FIG. 14, as seen along arrow XVI.

A modification of the previously described embodiment is shown in FIGS. 14 through 16, where the filler member 61 is equipped with two sealing plates 62 and 63. Underneath the outer sealing plate 62, which contacts the internal gear ring 2, are arranged two angularly spaced sealing battens 64 and 64'. To the space between the two sealing battens lead one or several radial bores 65 extending through the sealing plate 62, thereby equalizing the pressure in the space between the sealing battens 64 and 64' with the pressure inside the tooth chamber 66. Similar conditions exist with respect to the inner sealing plate 63 which contacts the pinion 1, and where the space between the sealing battens 67 and 67' is linked to the tooth chamber 68 by means of one or several radial bores 65' in the plate 63.

FIG. 15 shows, in enlarged detail, a portion of the sealing plate 62 surrounding its pressure equalizing bore 65. There, it can be seen that the bore 65 includes a tapered lead-in groove 69. A similar groove 69' may also lead into the bore 65' of the sealing plate 63. These tapered grooves produce a throttling action, as the tooth chambers 66 and 68 of the internal gear ring 2 and the pinion 1, respectively, are prefilled. This will assure that the prefilling fluid flow will not diminish under increasing viscosity of a pressure medium, such as oil.

FIG. 14 also shows a modification of the supporting pin 8 in the form of an abutment plate 70 arranged between the pin 8 and the filler member 61. This abutment plate reaches radially slightly beyond the abutment faces of the inner and outer sealing plates 62 and 63, thereby assuring that the sealing plates are not limited in their radial displaceability, as a result of wear on their abutment faces with the supporting pin 8.

Figure 17:
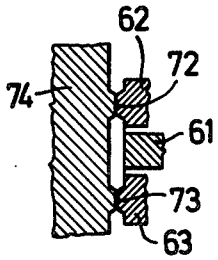
FIG. 17 is a partial cross section through the assembly of FIG. 14, taken along line XVII—XVII thereof.

The positioning and alignment of the sealing plates 62 and 63 in relation to the gears 1 and 2 can be improved if, as shown in FIG. 16, the sealing plates 62 and 63 have a slightly convex abutment face 71 with which they engage the supporting pin 8 or its abutment plate 70. In a similar fashion, it is possible to provide narrowed convex axial contact faces 72 and 73 on the sealing plates 62 and 63, respectively, where they engage a side plate 74 (FIG. 17).

Instead of being supported by the bearing shell 24 of the embodiment of FIG. 1, the internal gear ring 2 may also be supported hydrostatically, as shown in FIG. 14. For this purpose, the pump housing 75 has a segmental peripheral recess 76 which is supplied with pressure fluid through radial passages 77 which lead from the tooth chambers 66 to the outer periphery of the internal gear ring 2.

In FIGS. 18 and 19 is illustrated a preferred configuration of the axial side plate 74 which forms a lateral seal against the pinion 1 and internal gear ring 2. As can be seen in FIG. 19, the side plate 74 is received inside a matching axial recess of the pump housing 75. Compression springs 78, or undulated leaf springs 78', provide an axial bias for the side plate 74, via an intermediate pressure plate 79. Between the pressure plates 79 and the side plates 74 is further arranged a contour gasket 80. In FIG. 19, the left-hand length of the gasket 80 is shown in the assembled shape, while the shape of the right-hand length of the gasket 80 is shown as if in the free state. In order to assure that pressure fluid can reach the outer side of the pressure plate 79, the latter and the side plate 74 have aligned flow passages 81. Several of these passages may be provided in the two plates.

In view of the fact that a hydraulic gear pump of the type disclosed can also be operated as a hydraulic motor, when supplied with pressurized fluid, it should be understood that the term "gear pump", as used in the foregoing specification and in the appended claims, is to include in its meaning a structurally analogous gear motor.

It should further be understood, that the foregoing disclosure describes only preferred embodiments of the invention and that it is intended to cover all changes and modifications of these examples of the invention which fall within the scope of the appended claims.

I claim the following:

1. In a high pressure hydraulic gear pump of the type having a housing with a main bore accommodating therein a pinion surrounded by and cooperating with an internal gear ring, and a curved filler member occupying at least that end sector of the sickle-shaped space between the pinion and the internal gear ring where the gear teeth converge and in which the pressure space of the pump is located, in such a gear pump, the combination comprising:

a radially movable sealing plate interposed between at least one of the two peripheral surfaces of the filler member and the associated gear periphery, at a short circumferential distance from the converging gear teeth, the sealing plate having a curved outer surface in alignment with said associated gear periphery and bearing against the gear teeth which move along said gear periphery;

a shallow radial recess in the filler member, for the accommodation therein, with a small circumferential clearance, of the sealing plate;

means for positioning the sealing plate in the circumferential sense in relation to the filler member, said positioning means including a circumferentially forwardly facing abutment flank on the rear side of said radial recess;

means for biasing the sealing plate radially away from the filler member, towards said moving gear teeth, said biasing means including a pressure fluid space defined between the filler member and the sealing plate and channel means bringing pressurized fluid to said pressure fluid space, when the pump is in operation, said biasing means further including spring means engaged between the filler member and the sealing plate, for the creation of a radial bias which is also present when the pump is in a pressureless state; and means for positioning and abutting the filler member in the circumferential sense, against its inherent operative tendency of backing away from the converging, pressure generating gear teeth, at least that portion of the filler member which cooperates with the sealing plate being likewise radially movable, so that, under the influence of said sealing plate biasing means, the sealing plate bears at all times against one gear, while the filler member bears against the other gear, thereby taking up any changes in gear position due to manufacturing tolerances, or resulting from operational wear and displacements, under changing temperatures and pressures.

2. A gear pump combination as defined in claim 1, wherein at least some of the gear tooth chambers moving past the sealing plate contain pressurized fluid; and the pressure fluid space underneath the sealing plate is located opposite the pressurized tooth chambers and of such a size that the hydraulic pressures on the sealing plate are substantially neutralized in the radial sense.

3. A gear pump combination as defined in claim 1, wherein said channel means includes grooves in a forward edge portion of the sealing plate.

4. A gear pump combination as defined in claim 1, wherein the sealing plate has a rear face with which it abuts against the abutment flank of the radial recess in the filter member; and a bottom portion of said rear face forms a chamfer.

5. A gear pump combination as defined in claim 1, further comprising a transversely extending groove in the filler member, underneath the sealing plate, at a distance from the rear extremity of the latter, the groove being radially open towards the sealing plate and having a substantially radially extending, circumferentially forwardly facing positioning flank;

a radially movable sealing batten received inside said transverse groove, said batten engaging the underside of the sealing plate in the radial sense and said positioning flank in the circumferential sense, so as to form a metallic seal with both of them;

means for biasing the sealing batten radially outwardly towards the sealing plate; and channel means bringing pressurized fluid into the transverse groove, underneath the sealing batten.

6. A gear pump combination as defined in claim 5, wherein the transverse groove and the sealing batten have both a generally rectangular cross section; and the sealing batten biasing means is an undulated flat spring interposed between the bottom of the transverse groove and the sealing batten.

7. A gear pump combination as defined in claim 5, wherein the sealing batten has a cylindrical shape; and the sealing batten biasing means includes at least one spring so arranged that the sealing batten is not only biased against the sealing plate in the radial sense, but also against the positioning flank of the transverse groove, in the circumferential sense.

8. A gear pump combination as defined in claim 7, wherein the sealing batten biasing means includes at least two transversely spaced compression springs and a pressure ball interposed between each compression spring and the cylindrical sealing batten; and the pressure balls engage the sealing batten at an angle of approximately 45 degrees from the radial direction.

9. A gear pump combination as defined in claim 5, further comprising at least a second transverse groove in the filter member, underneath the sealing plate and circumferentially spaced from the first transverse groove, with a second sealing batten received therein; and a pressure equalizing bore in the sealing plate, leading from the gear contacting side thereof to the space between the two sealing battens.

10. A gear pump combination as defined in claim 1, wherein the sealing plate has on its circumferentially forward portion recessed control edges with which it delimits the pressure space and the suction space of the pump with respect to that gear whose teeth move along its outer periphery; and the filler member has on its circumferentially forward portion similar control edges with which it delimits the pressure space and the suction space of the pump with respect to the other gear.

11. A gear pump combination as defined in claim 10, wherein at least some of said control edges of the sealing plate and filler member include prefill channels for the tooth chambers of the associated gears, said channels having the form of circumferentially receding chamfers.

12. A gear pump combination as defined in claim 1, wherein the filler member has a shape which occupies less than one-half of the sickle-shaped space between the pinion and the internal gear ring;

the filler member positioning and abutting means includes a supporting pin extending transversely across said sickle-shaped space, circumferentially behind the filler member;

the supporting pin has a flat abutment face oriented forwardly, towards the filler member; and the filler member has a rear face engaging the abutment face of the supporting pin.

13. A gear pump combination as defined in claim 12, wherein the filler member has arranged in its rear face a pressure field in the form of a shallow recess; and the filler member further includes fluid channels bringing pressurized fluid to said pressure field.

14. A gear pump combination as defined in claim 12, wherein the filler member positioning and abutting means further includes an abutment plate on that side of the supporting pin which faces towards the filler member, the forward side of the abutment plate serving as said abutment face.

15. A gear pump combination as defined in claim 12, wherein the sealing plate extends circumferentially as far as the rear extremity of the filler member, so as to likewise engage the abutment face of the supporting pin, whereby the latter also serves as the sealing plate positioning means.

16. A gear pump combinations as defined in claim 15, wherein the rear face of the sealing plate has a slightly convex curvature over its width, so as to bear primarily against the midportion of the abutment face of the supporting pin.

17. A gear pump combination as defined in claim 1, wherein the filler member has a shape occupying less than one-half of the sickle-shaped space between the pinion and the internal gear ring; and the combination further comprises a second similar filler member occupying the opposite end portion of said sickle-shaped space, as well as a cooperating second sealing plate, thereby making the pump reversible.

18. A gear pump combination as defined in claim 1, wherein the filler member has a sickle-shaped contour occupying substantially the entire space between the pinion and the internal gear ring; and each end portion of the filler member has associated with it an inner and outer sealing plate cooperating with the pinion and internal gear ring, respectively, thereby making the pump reversible.

19. A gear pump combination as defined in claim 1, further comprising in the main bore of the pump housing, on the side towards which the internal gear ring is loaded under the thrust of the operating pressure, a substantially semi-cylindrical bearing shell which supports the internal gear ring; and spring means biasing the internal gear ring towards said bearing shell.

20. A gear pump combination as defined in claim 1, further comprising in the main bore of the pump housing, on the side towards which the internal gear ring is loaded under the thrust of the operating pressure, a shallow peripheral recess forming a pressure field for a hydrostatic bearing support of the internal gear ring, in opposition to said thrust; and radial fluid passages in the internal gear ring connecting the tooth chambers which contain pressurized fluid with said pressure fluid.

21. A gear pump combination as defined in claim 1, further comprising a pair of sector-shaped axial side plates closing the pressure space of the pump in the axial sense; and a pair of matching axial recesses in the pump housing.

22. A gear pump combination as defined in claim 21, wherein each axial side plate defines with its recess an axial compensation pressure field whose contour is defined by a secondary recess within said matching recess and by a contour gasket engaging a flank of said secondary recess; and the combination further comprises:

a pressure plate received inside said secondary recess so as to bear against the contoured gasket;

spring means preloading the pressure plate against said gasket in the direction toward the side plate; and channel means connecting said pressure field with the pressure space of the pump.

* * * * *